United States Patent [19]

Faust

[11] 4,234,227

[45] Nov. 18, 1980

[54] COLLAPSIBLE CHAIR

[76] Inventor: John A. Faust, 3921 Bentley Ave., Culver City, Calif. 90230

[21] Appl. No.: 45,120

[22] Filed: Jun. 4, 1979

[51] Int. Cl.[3] ..... A47C 7/00

[52] U.S. Cl. ..... 297/443; 297/440; 297/445; 297/448

[58] Field of Search ..... 297/440, 442, 443, 448, 297/445, 452, 454; D6/66

[56] References Cited

U.S. PATENT DOCUMENTS

| | | | |
|---|---|---|---|
| 98,440 | 12/1969 | Smith | 297/448 |
| 2,709,484 | 5/1955 | Lamb | 297/449 X |
| 2,830,656 | 4/1958 | Wagemans | 297/443 |
| 3,301,596 | 1/1967 | Eos | 297/443 |
| 3,847,435 | 11/1974 | Skinner | 297/443 |
| 3,861,746 | 1/1975 | Skinner | 297/440 |
| 4,129,332 | 12/1978 | Hoeholt | 297/440 |

FOREIGN PATENT DOCUMENTS

| | | | |
|---|---|---|---|
| 36384 | 4/1935 | Netherlands | 297/440 |

*Primary Examiner*—James T. McCall
*Attorney, Agent, or Firm*—Robert W. Mulcahy

[57] ABSTRACT

The invention relates to a two-piece collapsible chair, one of which pieces provides a backrest and rear leg element, and the other of which provides an inverted seven-shaped seat and frontal leg element. Both elements are constructed so that upon erection of the chair the inverted seven-shaped seat and frontal leg element engage and interlock the backrest and rear leg element about the vertex of the seven. Seating pressure biases the seat so as to enhance the interlocking engagement of the two pieces.

4 Claims, 5 Drawing Figures

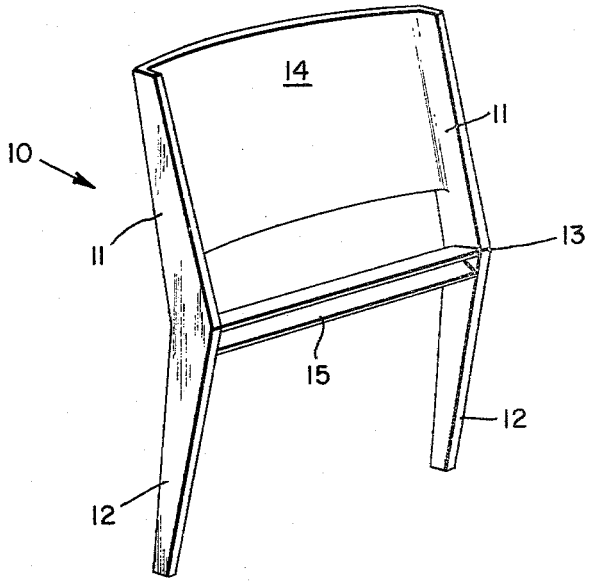
Fig. 1.
Fig. 2.
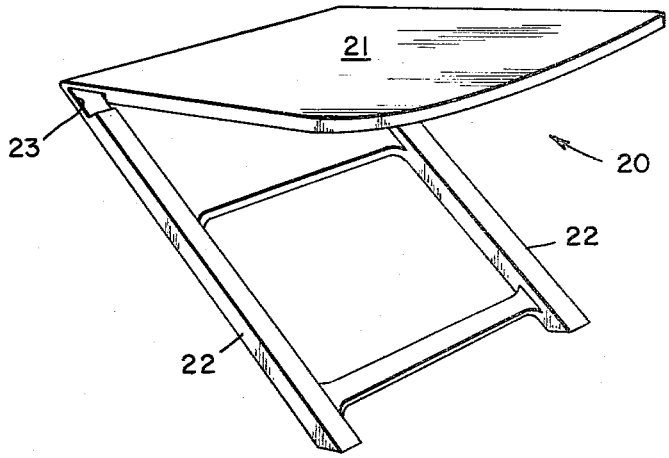
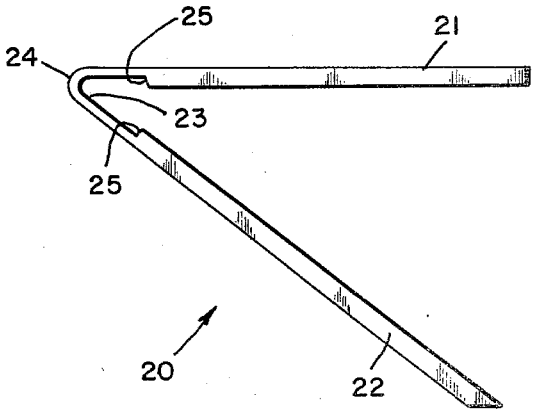
Fig. 3.

COLLAPSIBLE CHAIR

BACKGROUND OF THE INVENTION

This invention relates to chairs of the collapsible or knocked-down variety and particularly to chairs having but two elements and readily assembled and disassembled without supplementary securing means being either required or removed.

Chairs having rapid collapsibility or erection capability have been known and in use for many years. Early technology discloses chairs which are slotted and dovetailed to fit together so as to remain locked in assembled positions without auxiliary securing means, such as screws, nails and the like. More recently, U.S. Pat. No. 3,847,435 discloses a two-piece chair comprised of two flat elements which are shaped so as to mate in an interlocking arrangement, thereby forming a convenience chair which is easily disassembled and erected. In the patented device the nature of the interlocking relationship between the two pieces demands that the two elements be of a flat construction and therefore of limited utility as a comfort seating device in home or formal uses.

In U.S. Pat. No. 3,427,074, there is disclosed a two-piece chair comprised of two rigid parts, one having a transverse opening through which the other part is slidably insertable to form a rigid seating structure. This type of collapsible structure is almost totally amenable to outdoor convenience use such as at beaches, parks, etc.

It is an object of the present invention to provide a novel chair requiring only two pieces which engage and interlock to form a chair for any use without requiring auxiliary securing means. The nature of the interlocking relationship of the two elements is such that the two pieces may be readily separated and the common elements of a plurality of chairs may be conveniently stored in compact arrangements. Another advantage of the present invention is that the chair elements may be made of any suitable material such as metal or plastic material. A still further benefit of the present invention is that the chair elements are not shape limited and therefore may be comfort constructed.

BRIEF DESCRIPTION OF THE DRAWINGS

To enable the invention to be more clearly understood and practiced, reference is now made to the accompanying drawings in which:

FIG. 1 is a plan view of one element constituting the backrest and rear leg portion of the chair.

FIG. 2 is a plan view of the second element constituting the seat and frontal leg portions of the present chair.

FIG. 3 is a side view of the seat and frontal leg elements of the instant chair.

DESCRIPTION OF THE PREFERRED EMBODIMENT

Figure 4:
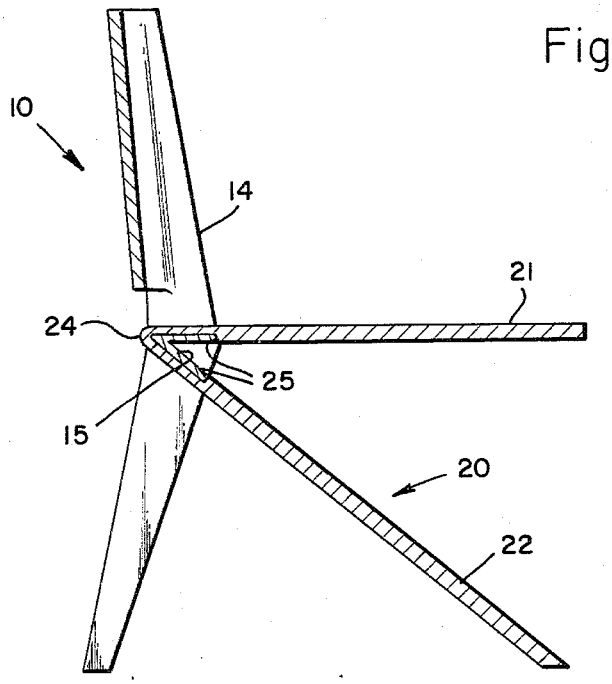
FIG. 4 is a side view of the cooperating interlocking elements of the present chair.

The chair of the instant invention includes a seating structure comprising a backrest and rear leg elements and an inverted seven-shaped seat and frontal leg element, both of which interlock to form a conveniently erectable and collapsible chair. The instant chair is easily and compactly stored by way of its common elements and readily assembled for convenience and/or domestic use.

Referring now to FIG. 1, reference 10 denotes one part of the instant two-piece chair which includes sidings 11 and back leg elements 12 joined at an elbow junction 13 at an obtuse angle. The sidings 11 and the back leg elements of the chair are shown in FIG. 1 as in pairs joined by bracketing element 14 which acts as the backrest of the ultimately constructed chair. The siding elements 11 and the back leg elements 12 are further supported by center bracket 15 to form an integral frame of the total backrest and back leg portion 10 of the present collapsible chair.

Referring now to center bracket 15 of the backrest-/rear leg frame element 10, there is demonstrated a structure transverse to the width of the frame 10 comprising two flat sheets angularly bonded together to the rear of the frame so as to form a V-shaped bracket which is compressible about the horizontal plane of the chair piece 10. As will be appreciated hereinafter it is the compressibility and shape of this transverse bracket element 15 which enables the interlocking relationship between the two pieces of the instant chair. It should be further appreciated that, while the transverse element 15 has been described as triangular in shape in this embodiment, the transverse central bracket of the present invention may be of any shape as long as it is a compressible body over which a sleeve element may fit and interlock.

FIG. 2 demonstrates the seat and frontal leg portion 20 of the present chair invention. As can be seen, the seat element 21 is a flat surface having a width approximating the transverse bracket 15 of FIG. 1 referred to above, and is angularly joined together with frontal leg elements 22 at the vertex designated as 23 in a reverse seven-shaped piece 20.

FIG. 3 illustrates a side view of the seat and frontal leg portions 20 in which each is joined at an acute angle 23 and the intersection of the two portions is in a circumferential or smooth construction. Additionally, both the frontal leg element 22 and the seating element 20, while in a relatively flat configuration, are reinforced with additional material, whereas the outer intersection area 24 (and inner vertex area 23) is of a relatively thinner construction, thereby creating rib elements 25 which transverse the width of the seat and frontal leg portion 20 of the collapsible chair. The thin inner circumferential area 23 of FIG. 3 conforms approximately to the outer area of bracket element 15 of FIG. 1 so as to act as an outer sleeve when the seat and frontal leg portion 20 is placed about bracket 15 and the ribs 25 interlock about the compressible structure.

Returning again to FIG. 3, it should be apparent to one skilled in the art that intersection angle 23 of the seat frontal leg piece should be slightly more acute than the angle of intersection of the two flat sheets of bracket 15 so as to cause a compression force about bracket 15 such that when they interact the resulting force should cause tighter interlock of the ribs 25 about the bracket 15.

Turning now to FIG. 4, there is demonstrated a side view of the erected chair 30. Note the interaction of the seat and frontal leg portion with the backrest back leg portion 10 to form a completely integral chair unit. It should be appreciated by one skilled in the art that as force is applied to seating element 21 by one being seated, dispersed and opposing forces are applied to both front and rear leg elements of the chair as well as about compressible brace elements 15, which causes a greater interlocking reaction between the ribs 25 of FIG. 3 and the brace element 15 of FIG. 1, thereby enhancing the interlocking relationship between seat and frontal leg element 20 and the backrest back leg portion 10 of FIGS. 1, 2, and 3.

Figure 5:
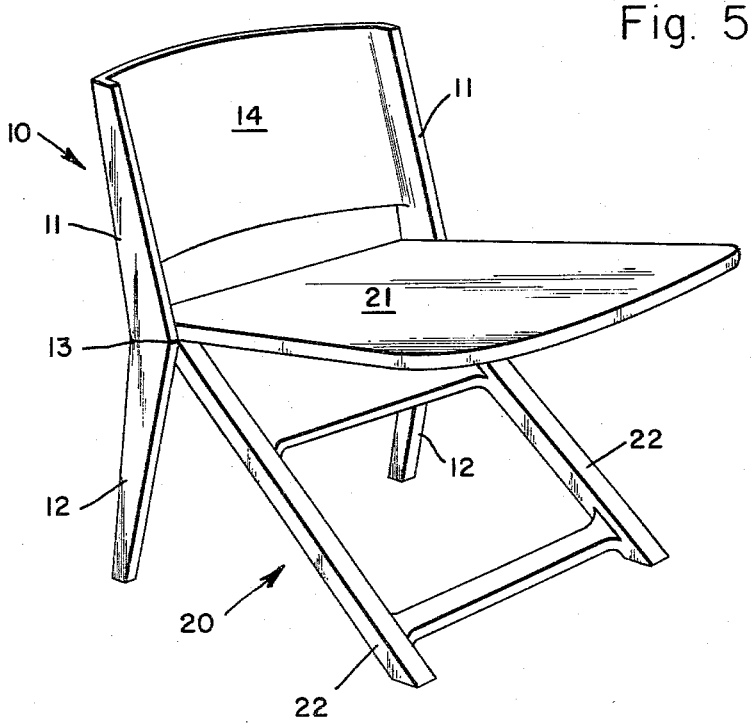
FIG. 5 is a perspective view of the chair in its assembled state.

Referring now to FIG. 5, there is demonstrated a pictorial view of the instant collapsible and easily erectable chair 40. As can be appreciated from the figure, the present invention is not limited to any one type of chair. For example, beach chairs as well as home seating elements could be prepared within the purview of the present invention. Additionally, more sophisticated elements may be added to the instant chair and not depart from the spirit of the present disclosure. For example, upholstery pads may be affixed to the seating element to render the chair more amenable for domestic use. Additionally, the leg elements may be fortified so as to have a chair having a rugged and heavy construction. Still further, leaves and additional braces may be added along with shorter front and rear leg portions to form a lounge chair. For example, an extended leaf may be appended to the lead edge of the seat and supported by additional legs to form a leg rest component of a lounge chair.

It is to be understood that this invention is not to be limited in any way by the exact embodiment shown, which is merely by way of illustration and not limitation, as various other forms of the device will be apparent to those skilled in the art without departing from the spirit of the invention or scope of the claims.

What is claimed is:

1. A collapsible chair comprising:

a unitary backrest and rear leg portion having a compressible brace transversing the width of the unitary structure;

and a reversed seven-shaped seat and frontal leg portion being compatible with the transverse brace portion of the backrest rear leg portion so as to interact with the compressible brace to form an interlocking sleeve, whereby a secure chair structure is formed.

2. The collapsible chair of claim 1 wherein the compressible transverse brace is comprised of two flat sheets intersecting to the rear of the backrest/rear leg portion.

3. The collapsible chair of claim 1 wherein the compressible transverse brace is a unitary structure and having a semi-circular shape.

4. The collapsible chair of claim 1 wherein the reversed seven-shaped seat and frontal leg portion contain rib elements which secure the interlocking relationship with the backrest and rear leg portion.

* * * * *